United States Patent [19]

Obermeier et al.

[11] 3,948,558

[45] Apr. 6, 1976

[54] SEAT BACKREST HAVING AN ADJUSTABLE LUMBAR SUPPORT

[75] Inventors: Albert Anthony Obermeier, Waterloo; James Edward Thompson, Cedar Falls, both of Iowa

[73] Assignee: Deere & Company, Moline, Ill.

[22] Filed: Mar. 31, 1975

[21] Appl. No.: 563,611

[52] U.S. Cl. ..... 297/284
[51] Int. Cl.[2] ..... A47C 3/00
[58] Field of Search ..... 267/89; 297/284

[56] References Cited

UNITED STATES PATENTS 3,463,544 8/1969 Froelich ..... 297/284

FOREIGN PATENTS OR APPLICATIONS 1,011,726 12/1965 United Kingdom ..... 297/284
1,914,154 6/1971 Germany ..... 297/284

*Primary Examiner*—James C. Mitchell

[57] ABSTRACT

A seat backrest having a contourable upholstered portion supported by a rigid frame includes means to impart a curvature to the upholstered portion to produce a desired supporting contour in the lumbar area of the seat's occupant. The contour-producing means includes a lumbar pad, a flexible member connecting the lumbar pad to the frame, and means operable from the side of the backrest for moving and holding the connecting member in a plurality of positions.

8 Claims, 3 Drawing Figures

SEAT BACKREST HAVING AN ADJUSTABLE LUMBAR SUPPORT

BACKGROUND OF THE INVENTION

The present invention relates generally to vehicle seats and more particularly to a seat backrest whose contour is adjustable to conform to the lumbar contour of a particular occupant.

In the past, seats having contourable backrests made use of screw and bushing combinations positioned at the center of the back or at the side of the seat which were not easily adjustable by a seated occupant and which required multi-turn adjustments before the desired contour could be obtained.

SUMMARY OF THE INVENTION

It is a general object of the present invention to provide an improved vehicle seat backrest having an adjustable lumbar support which may be easily adjusted at the side of the backrest through the full range of adjustment in one motion by a seated occupant to fit his personal contour. Detent means are provided to eliminate the need to depend on the frictional hold of a screw in order to maintain a particular setting of the lumbar support.

The above and additional objects and advantages of the present invention will become apparent to those skilled in the art from a consideration of the following detailed description of a preferred embodiment of the invention when taken in conjunction with the accompanying drawings.

DESCRIPTION OF THE PREFERRED EMBODIMENT

Figure 3:
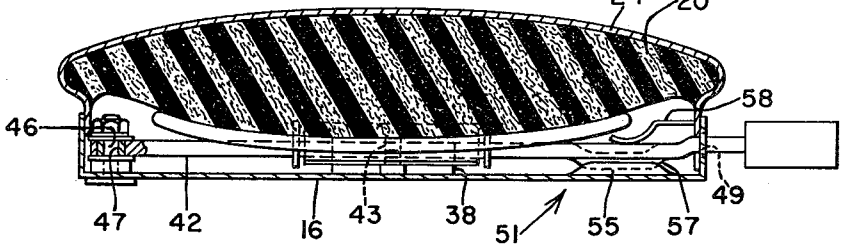
FIG. 3 is a section taken along the line 3—3 of FIG. 1.

Referring now to the drawings, there is shown a seat backrest 12 having a rigid frame 16 and a resilient elastomeric layer 20 which is covered by a flexible covering 24 of a fabric or vinyl material.

An adjustable lumbar support, shown at 30, imparts a curvature to the flexible covering 24 in the lower portion of the backrest 12 shown as a lumbar area 26. The adjustable lumbar support 30 includes a lumbar pad 32 pivotally attached by pins 33 to a flexible pivot plate 36 which is further pivotally connected to the base of the frame 16 by pins 35.

Figure 2:
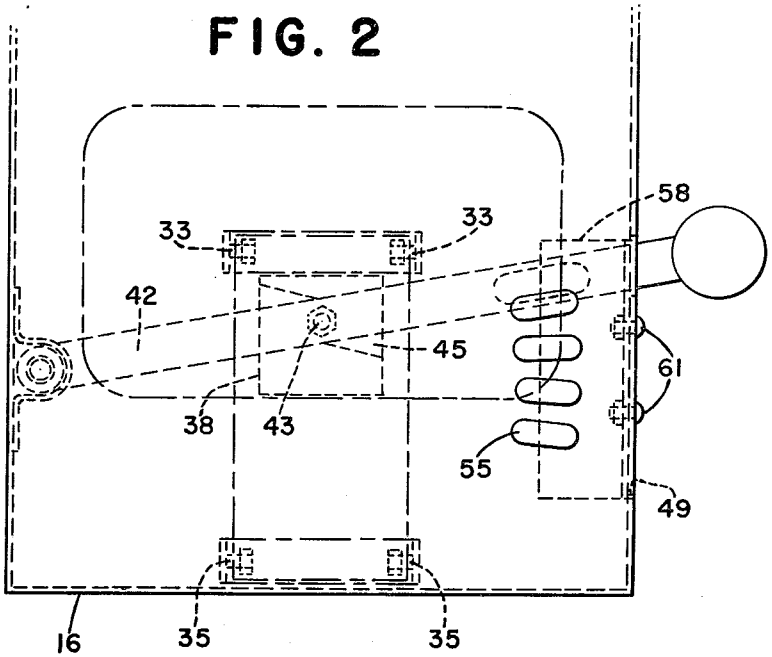
FIG. 2 is a partial rear view of the present invention.
Figure 1:
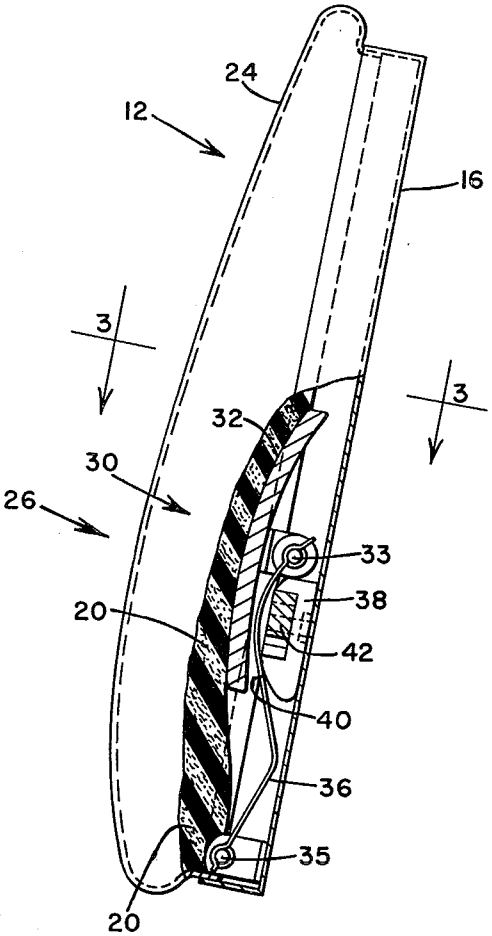
FIG. 1 is a partial section side view of a seat backrest embodying the present invention.

To make the lumbar support 30 adjustable, there is provided a wedge block 38 having a camming surface 40 slidably inserted between the pivot plate 36 and the frame 16. The wedge block 38 is rockably mounted as shown in FIGS. 2 and 3 to an adjusting lever 42 by a pin 43. The wedge block 38 contains an hourglass shaped recess 45 as shown in FIG. 2 for receiving and providing rocking clearance for the adjusting lever 42 as it moves parallel to the frame 16 and the wedge block 38 slides substantially vertically. The adjusting lever 42 is pivotally connected at one end by a bolt 46 and a bushing 47 to the frame 16 while the other end protrudes through a slot 49 in a flange of the frame 16 exterior to one side of the backrest. The length of the slot 49 controls the range of adjustment of the adjusting lever 42 and the position of the slot is generally on the right hand side of a seated occupant.

To hold the adjusting lever 42 in a plurality of positions, a detent, generally indicated at 51, is provided. The detent 51 includes a plurality of frame protrusions 55 in the back of the frame 16 which are designed to engage a protrusion 57 provided in the adjusting lever 42. To hold the lever protrusion 57 and the frame protrusions 55 in engagement, there is provided a leaf spring 58 which is attached by screws 61 to the frame 16.

In operation the occupant of the seat reaches back and pushes down in one motion on the adjusting lever 42 for full range forward movement of the lumbar area 26 or upward in one motion for full range backward movement.

Forward movement of the lumbar area 26 is afforded by the camming action of the wedge block 38 as the camming surface 40 slides along the pivot plate 36 towards the pins 35. This moves the lumbar pad 32 forward against the elastomeric layer 20 and the flexible covering 24. Rearward movement occurs as the wedge block 38 slides away from the pins 35 allowing the pivot plate 36 to pivot towards the frame 16 due to the resilience of the elastomeric layer 20.

As the adjusting lever 42 is manually pivoted about the bolt 46, the lever protrusion 57 cams out of engagement with the frame protrusions 55 and loads the leaf spring 58. At each detent holding position, of which there are five, the leaf spring 58 urges the lever protrusion 57 into engagement between or to one side of the frame protrusions 55 so as to prevent movement which could be caused by the occupant leaning back in the seat or by the weight of the adjusting lever 42.

The flexibility of the pivot plate 36 combined with the overhang created by the wedge block 38 sliding towards the pins 35 provides increasingly resilient support for the occupant's lumbar area which is particularly important for absorbing shocks in vehicles used on rough terrain.

While the invention has been described in conjunction with a specific embodiment, it is to be understood that many alternatives, modifications, and variations will be apparent to those skilled in the art in light of the aforegoing description. Accordingly, it is intended to embrace all such alternatives, modifications, and variations which fall within the spirit and scope of the appended claims.

We claim:

1. A seat backrest comprising: a rigid frame supporting a contourable portion constituted by a flexible covering and an elastomeric layer interposed between the covering and the frame; and means between the frame and the covering to impart a curvature to the covering to produce a desired lumbar contour including a lumbar pad, a pivot plate pivotally attached at one end to the frame and to the lumbar pad at the other, and camming means including a wedge block slidably inserted between the pivot plate and the frame, and manually operable means extending to one side of the backrest for sliding the wedge block towards and away from the point of pivotation of the pivot plate to cam the lumbar pad into a plurality of positions.

2. The invention as claimed in claim 1 wherein the elastomeric layer is resilient to urge the pivot plate towards the frame.

3. The invention as claimed in claim 2 wherein the manually operable means includes an adjusting lever having position detent means and the frame includes engagement means engaging with the detent means for holding the lever in a plurality of positions.

4. The invention as claimed in claim 3 wherein the position detent means includes a rearwardly facing protrusion on the adjusting lever and the engaging means includes forwardly facing protrusions on the frame.

5. The invention as claimed in claim 4 wherein the manually operable means further includes spring means for urging the position detent means into engagement with the engagement means.

6. A seat backrest comprising: a rigid frame supporting a contourable portion constituted by a flexible covering and an elastomeric layer interposed between the covering and the frame; and means between the frame and the covering to stretch and impart a curvature to the covering to produce a desired lumbar contour including a lumbar pad, a flexible pivot plate pivotally connected to the frame for pivotation about an axis parallel thereto and pivotally connected to the lumbar pad, a lever pivotally connected to the frame for pivotation about an axis perpendicular thereto and extending exteriorly to and to one side of the backrest, and a substantially wedge-shaped block rockably mounted to the lever and positioned for camming the pivot plate away from the frame.

7. The invention as claimed in claim 6 wherein the elastomeric layer is resilient to urge the pivot plate towards the frame.

8. The invention as claimed in claim 6 wherein the lever includes a rearwardly facing protrusion for engagement with a plurality of forwardly facing protrusions in the frame for holding the lever in a plurality of positions, and spring means for urging the rearwardly facing protrusion into engagement with the forwardly facing protrusions.

* * * * *